United States Patent [19]

Lindquist

[11] 4,146,984

[45] Apr. 3, 1979

[54] STRUCTURAL ASSEMBLY FOR DISPLAY OF PICTORIAL MATTER

[76] Inventor: Carl G. Lindquist, 230 Foster St., Littleton, Mass. 01460

[21] Appl. No.: 711,637

[22] Filed: Aug. 4, 1976

[51] Int. Cl.[2] ..... G09F 1/12

[52] U.S. Cl. ..... 40/152; 40/10 R

[58] Field of Search ..... 40/64 R, 63 A, 106.1, 40/10 R, 152.1, 152

[56] References Cited

U.S. PATENT DOCUMENTS

| | | | |
|---|---|---|---|
| 1,406,464 | 2/1922 | Lawrence | 40/152.1 |
| 2,602,254 | 7/1952 | Diekmann | 40/152 |
| 2,957,262 | 10/1960 | Knox | 40/152 |
| 3,041,761 | 7/1962 | Knox | 40/152 |
| 3,251,151 | 5/1966 | Sherril | 40/152 |
| 3,254,927 | 6/1966 | Harvey | 40/152 X |

FOREIGN PATENT DOCUMENTS

| | | | |
|---|---|---|---|
| 505378 | 9/1951 | Belgium | 40/152.1 |

*Primary Examiner*—Russell R. Kinsey
*Assistant Examiner*—Wenceslao J. Contreras

[57] ABSTRACT

This invention relates to the display of pictorial matter such as paintings, water colors, photographs, graphic art, or other two-dimensional art. The invention consists of a structural assembly in the form of a display box, or kit of parts from which such a box can be constructed, having a front frame with an inner cut-out portion through which the pictorial matter is viewed, and means to locate the pictorial matter in a variety of distances and dispositions recessed behind the front frame. The pictorial matter may be disposed parallel to the viewing frame, at an angle thereto, or in two or more angles relative to the viewing frame, or in a curvilinear surface.

12 Claims, 14 Drawing Figures

STRUCTURAL ASSEMBLY FOR DISPLAY OF PICTORIAL MATTER

The invention will be described with reference to the display of photographic prints for which it is well adapted although it will be understood that it is applicable to other pictorial matter as well.

Photographic prints intended for formal display or exhibition are frequently mounted on a mat board of larger dimensions than the photographic image so as to provide a mat surround. An alternative method of displaying a photographic print, also frequently used, is to mount the print on a backing sheet or board and to mount over the edges of the photograph and over the backing sheet a mat surround with the edges of the opening of the mat in contact, or nearly in contact, with the photographic image. Another method of mounting a photographic print for display consists of mounting the print, without borders, on a backing board of the same dimensions as the borderless print so that there is no surround. In all of these forms of display, as is also the case with an unmounted print, what is presented is a two-dimensional image with the limits of that image well defined to the viewer.

I have observed that for many photographs a viewer with workable binocular vision will sense a marked enhancement in his perception of reality if a mat surround is brought forward a suitable distance toward the viewer and if the window cut-out in the mat is of such dimensions, smaller than those of the image, that its projection upon the image by the lines of sight of the viewer, from a normal position of viewing, defines a picture with edges within the corresponding edges of the image. This phenomenon of enhancement in reality perception is apparently the result of two eye-mind functions, one relating to depth cues and the other to the extension of a scene, in real life vision, beyond the area upon which the eyes are concentrating, or scanning, at a given time. The enhancement in depth perception apparently occurs, at least in part, because the mat containing the window is, with binocular vision, a frame of reference for distance in the third dimension such that objects in the picture image are more strongly perceived to be at a distance from the viewer related in some incompletely understood way to the distance from the plane of the mat, or window, to the image and to the scale of size of objects in the image and to other depth cues in the image. The effectiveness of the other eye-mind function is more clearly understood. When one looks at a scene through the window of a mat separated from the image knowing that the limits of the scene extend beyond those defined by the window as can be verified by shifting the angle of view, a process that goes on automatically in binocular vision, the mind interprets what is seen as a portion of a larger scene just as it does when looking through a window, or equivalent frame, at real objects.

While my invention may be said, in general terms, to derive from the enhancement in the perception of reality that results from the above described eye-mind functions when a picture is viewed through the window of an intervening mat frame, there are further discriminations and elaborations in the underlying principles and accordingly in the forms and functions of the various embodiments of the invention. Such further detail will be brought out in the subsequent description of the invention.

The general object of may invention is to provide a structural assembly, or display box, or a kit of parts and materials from which such an assembly can be readily constructed, so that the user can mount a photographic print, or other pictorial matter, in a position recessed behind a mat surround viewing frame. The cut-out portion, or window, in the viewing frame is smaller in dimensions than the pictorial matter so that the viewer from a normal viewing distance and position will not see the edges of the photographic image or other pictorial matter. The edges of the scene viewed from such distance and position are defined by the edges of the window as these are projected upon the image by the viewer's lines of sight.

A further object of my invention is to provide a structural assembly in which the user may select one of a plurality of distances between the front viewing frame and the pictorial matter surface or, alternatively, may select any distance within a range. Thus the user may select a distance which, according to the size of the image and the composition of the scene, will effectively enhance the perception of reality and the aesthetic appreciation of viewers.

A further object of may invention is to provide a structural assembly in which the pictorial matter may be mounted in various dispositions relative to the viewing frame; thus I provide a display box in which the pictorial matter may be disposed parallel to the viewing frame, at an angle thereto, or may be bent, or cut, or produced from separate pieces, and mounted with different portions of the scene disposed at different angles relative to the viewing frame, or it may be mounted as a curved surface.

It is a further object of my invention to allow selected pictorial matter mounted in a recessed position behind a viewing frame to be displayed with any portion of the reflected light that enables the viewer to see it to reach the surface of the pictorial matter from behind the viewing frame. Thus the viewer's perception of reality may be further enhanced, and striking artistic effects may be achieved in the display of pictorial matter.

In the simplest form and application of my invention pictures are mounted parallel to a viewing frame with cut-out window smaller in dimensions than the image area and at a standard distance, according to the size of the picture, behind the viewing frame. With this mounting most photographs will be aesthetically preferred as compared to conventional methods of mounting pictures for display and there is a significant enhancement in perception of reality for pictures depicting reality. As I have indicated even greater aesthetic appreciation and greater enhancement in the perception of reality can be achieved, in general, by mounting various pictures at different distances behind the viewing frame and in different dispositions depending upon both the size and the subject matter and composition of each picture. Thus, for example, some pictures provide a greater enhancement in the perception of reality, with particular reference to the perception of depth, when they are mounted inclined at an angle to the viewing frame rather than parallel thereto. As a general, but not an absolute, rule the portion of the scene that is closest to a viewer will be mounted closest to the viewing frame and the more distant portion of the scene farther from the viewing frame. A typical example of such a case is a picture in which there is a foreground in the lower portions of the picture and a skyline of somewhat distant trees, buildings, or hills at the top of the picture with objects at intermediate distances in the middle region of the picture.

There are some pictures which can be mounted with marked enhancement in the perception of reality and also marked improvement in the aesthetic appreciation of viewers by dividing the picture into two or more areas bounded by straight lines and mounting these areas as planes at different angles to the plane of the viewing frame or window. Such techniques require careful craftsmanship which may include retouching of the lines of intersection of the separate planes, but the skill required is not beyond the usual capabilities of even the amateur artist or photographer.

Occasionally there is a picture for which the perception of reality is most enhanced if it is mounted, or a portion of it is mounted, with a curvilinear surface such as a cylindrical surface or a conical surface. Such mountings as well as those previously described can be made with preferred embodiments of my invention.

With reference to the drawings,

FIG. 1 is an isometric view of one typical form of the invention. A picture is located parallel to the viewing frame and the sides of the display box are left open in this illustration. Any number of the four sides of the box may be left open in use or closed with opaque, transparent, or transluscent panels.

Figure 4:
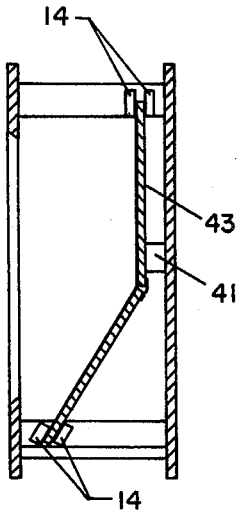
Figure 4:
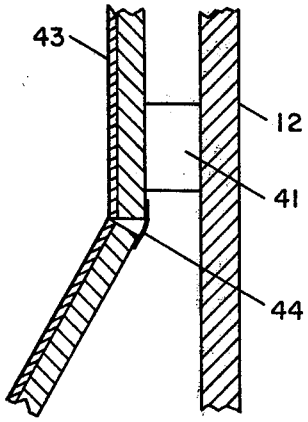

FIG. 4*a* is a similar cross-sectional view with a picture consisting of two planes, one disposed at one angle to the viewing frame and one at a different angle. FIG. 4*b* is an enlargement of a portion of FIG. 4*a*.

Figure 5:
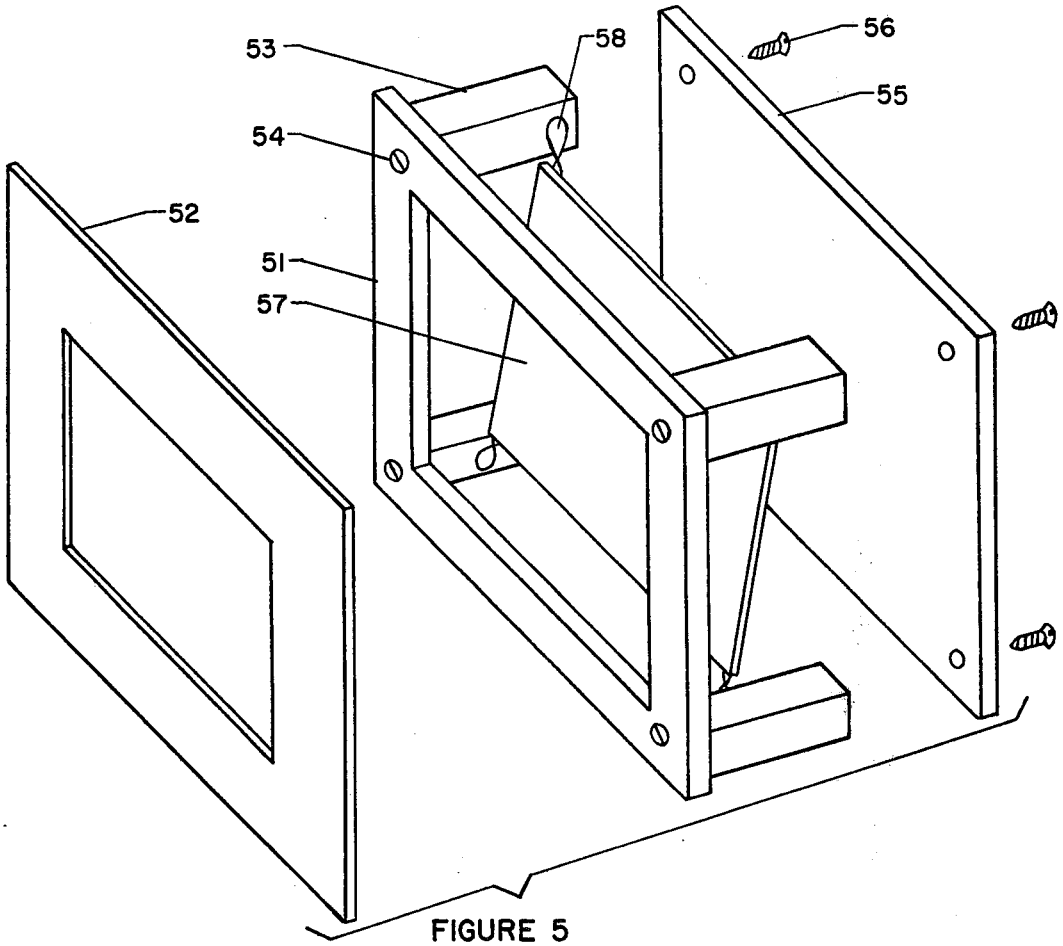

FIG. 5 is a partial exploded view of another embodiment of the invention. As in the case of FIG. 1 side panels which may be used optionally to enclose the sides of the display box are not shown in FIG. 5.

Figure 7:
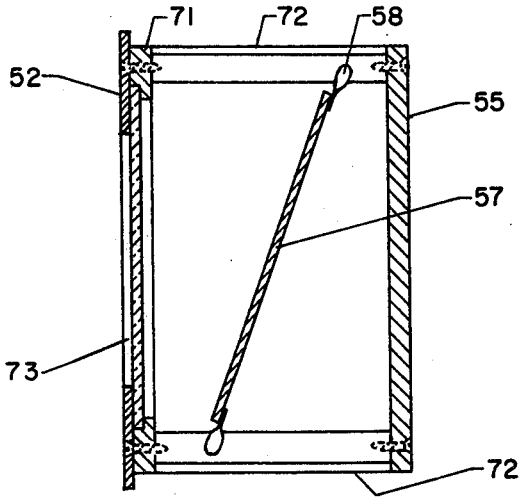

FIG. 7 is a cross-sectional end view, taken through a central plane of FIG. 5, of an assembled display box of the same general construction as shown in FIG. 5. A solid transparent window, 73, which may be plastic or glass, is shown in FIG. 7 to illustrate this option.

FIG. 6, FIGS. 8*a* and 8*b*, and FIGS. 9*a* and 9*b* show three types of slotted "corner posts" which allow positioning of each corner of the prepared pictorial matter at one of several distances from the viewing frame.

Figure 10:
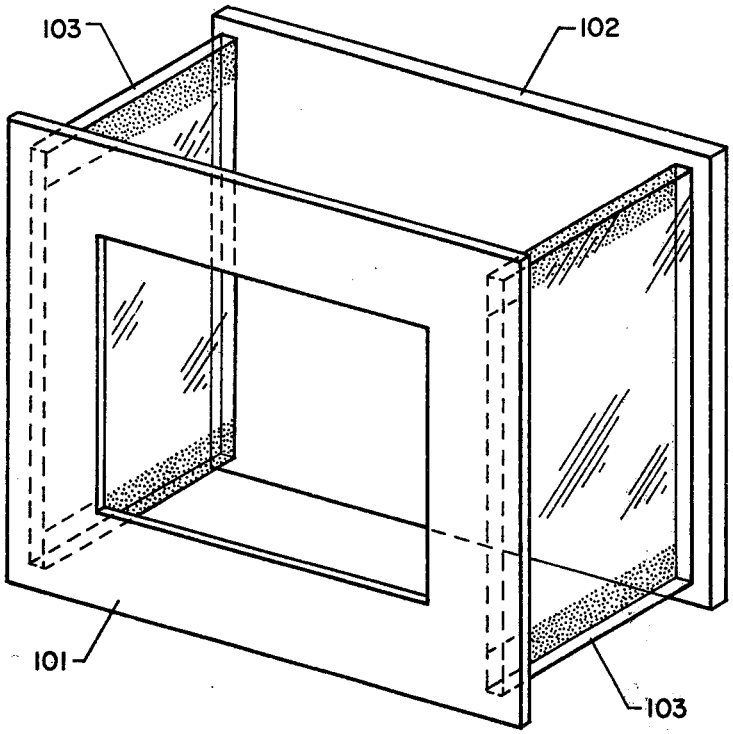

FIG. 10 is an isometric view of an alternative embodiment of the invention in which two spacing panels are employed rather than four individual corner posts.

Figure 11:
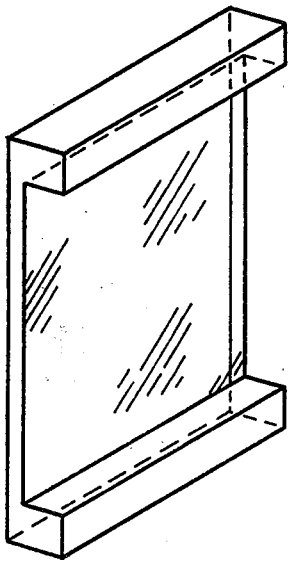

FIG. 11 is an alternative structure of the spacing panel, 103, shown in FIG. 10.

Figure 1:
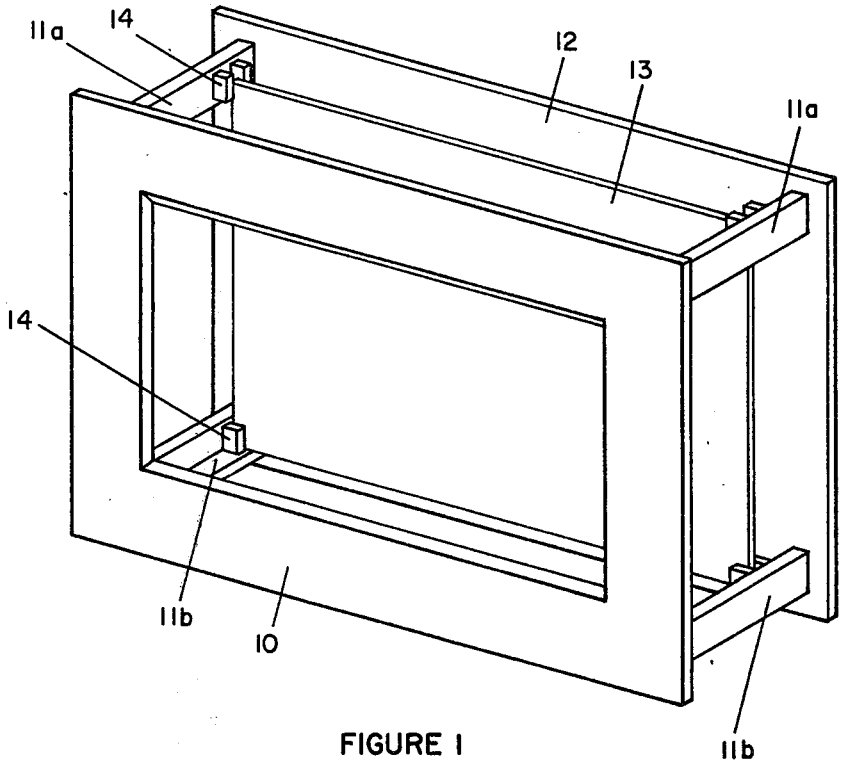

In FIG. 1, 10 is a mat viewing frame. The corner posts, 11*a* and 11*b*, are secured to the viewing frame and to the back panel, 12, either permanently as by gluing or cementing or in removable manner. For example screws may be used to hold either the mat viewing frame or the back panel, or both, to the corner posts. When screws are used to hold the viewing frame to the corner posts they are chosen to be aesthetically pleasing as are the visible screw heads on fine furniture or upholstery.

In the embodiment of the invention shown in FIG. 1 the top corner posts, 11*a*, are of rectangular cross-section while the lower corner posts, 11*b*, are of "L" shaped cross-section with open sides of the L facing inwardly. The inner surface of the upright portion of each of these L-sectioned corner posts is in the same plane as the inner surface of the top corner post on the same side of the box. Thus a photographic print mounted on a backing sheet, 13, or any pictorial matter of appropriate overall size, may be inserted between the inner faces of the upper corner posts and its lower portion between the inner faces of the upright parts of the lower corner posts with small clearance, coming to rest on the upper surfaces of the horizontal base section of the L-shaped lower corner posts. The picture is positioned at each corner between the viewing frame, 10, and the back panel, 12, by depth position blocks, 14, cemented to the appropriate inner faces of the corner posts after the desired location of the picture is determined. When any corner of the picture is to be adjacent to either the rear face of the viewing frame or the forward face of the back panel only one depth position block is used rather than a pair. The depth position blocks are generally about ¼" thick in the horizontal dimension as shown in FIG. 1. The picture, or backing sheet, is then chosen or cut to be 1/16" to ⅛" less in width than the distance, measured along the edge of the picture or backing sheet in its display position, between opposite vertical faces of the corner posts. Thus the picture will be retained in the channels created by the depth position blocks, regardless of the disposition of the picture, provided the blocks are cemented at the correct angle and to the appropriate inner face of the corner post. In FIG. 1 the depth position blocks are shown cemented to the vertical faces of the corner posts to accomodate a picture disposed parallel to the viewing frame. In this case they could equally well be cemented to the horizontal inner faces extending horizontally inward about ¼" beyond the vertical inner face of the corner post. For other dispositions it will usually be preferred to cement the blocks to either the vertical or the horizontal inner faces of the corner posts in order to conveniently locate and retain the picture in the channels. Alternatively the pictorial matter, or a backing sheet, may be bent along its edges to fit the orientation of the channels.

The L-section design of the bottom corner posts, 11*b*, provides a convenient shelf for pictorial matter to rest upon particularly when determining its permanent position. However it is a feasible alternative to employ all four corner posts of the same simple design shown in FIG. 1 at 11*a*, employing other means to prevent the pictorial matter from sliding through. A panel may be fixed across the bottom faces of the lower corner posts as one means or a block may be attached to the vertical face of each lower corner post.

The structural assembly, or display box, shown in FIG. 1 is applicable for a picture for appropriate dimensions in either a horizontal or vertical format. In either case the picture, usually mounted on a backing sheet, may enter from the top as shown in FIG. 1, or if the back is removable, may enter from the back. A backing sheet is used primarily to provide stiffness and flatness to thin and flexible pictorial matter such as standard photographic prints. It may also function to provide dimensions to properly locate the picture relative to the window in the viewing frame or to fit between the corner posts and within the channels on the corner posts. It may, therefor, be of the same facial dimensions as the print when the latter is of correct dimensions to be properly fit in the display box, or it may be larger than the print in one or both facial dimensions when the print is too small for proper fitting in the display box.

The assembly shown in FIG. 1 has open sides between the front viewing frame and the back panel. It may be used for display in this form or the user may prefer to close some, or all, of the four sides with appropriate panels, for aesthetic reasons, to prevent dusk from entering the sides, to control the light that can enter these sides, or for a combination of such reasons. Such panels may be opaque, clear transparent, clear color filters, or transluscent with or without color-filtering characteristics. While a wide variety of materials may be used for the side panels paperboard, wood, and plastic are preferred for opaque panels and plastic for transparent or transluscent panels. The panels may be held in position by gluing or cementing to the outer faces of the corner posts, by adhesive tape, by retaining ribs attached to the forward face of the back panel and the rear face of the viewing frame, or by other means. When retaining ribs are used they are located to provide channels between the outer faces of the corner posts and the ribs wide enough to receive the thickness of the panel and of individual length to assure that panels that are vertical in the display position will not slide through. Regardless of the means for holding bottom and side panels in position the top panel in the display position may simply rest on the top corner posts if that is preferred by the user. Such side panels are not necessarily a part of the product of manufacture and sale but optionally may be provided as such.

Figure 2:
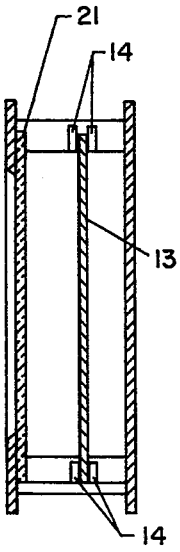
FIG. 2 is a cross-sectional view of an assembly similar to that shown in FIG. 1. A solid transparent window is shown in FIG. 2 to illustrate this option.
Figure 3:
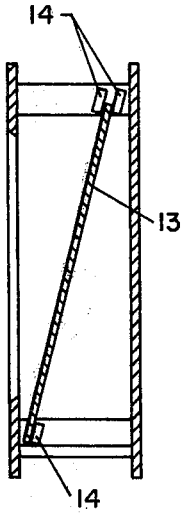
FIG. 3 is a cross-sectional view of an assembly similar to that shown in FIG. 1 but in this case the pictorial matter is inclined.

FIG. 2 is a cross-sectional view of an assembly similar to that shown in FIG. 1 with the picture mounted parallel to the mat viewing frame. Additionally at 21 is shown a solid transparent window to illustrate this option. Such a window may be clear or tinted and may be of plastic or glass. Although not necessary for most situations such a window can serve to avoid dust or other intrusions. FIG. 3 is a similar cross-sectional view except that the picture is inclined in this case. In the product of my invention a picture may be inclined from top to bottom or from left to right, and there is the further option of an inclination with respect to both horizontal and vertical axes (or edges) of the viewing frame.

In FIGS. 4*a* and 4*b*, 41 is a positioning member, such as a block or vane, cemented to the back of the pictorial matter and to the forward face of the back panel, 12, of the display box. Alternatively such a block could be fixed to a bottom panel and the lower portion of the picture, in this example. One or more such positioning members may be provided by the user to finally fix and hold a divided multi-planar picture in its desired planes. 43 is the picture mounted on a backing sheet and 44 in FIG. 4*b* is a strip of adhesive tape, provided by the user, which extends along the joint between two planes to hold the two planes together and to permit by its flexibility, insertion of the picture through fixed channels which may be in, on, or attached to, the corner posts.

FIGS. 2,3, and 4*a* do not exhaust the various possible dispositions of a picture in the product of my invention. It will be obvious, for example, that a picture could be bent or divided into more than two planes. It has already been mentioned that a uni-planar picture may be inclined at angles to both the horizontal and vertical axes of the viewing frame. By the same token a multi-planar picture need not have any plane whose intersection with the plane of the viewing frame is a line parallel to either axis of the viewing frame. Further a picture can be disposed in a curvilinear position employing a backing sheet, if such is necessary, of sufficient flexibility and of appropriate dimensions to fit between the corner posts and be retained at its corner by the means provided.

A product of the basic structure shown in FIG. 1 may be made of various materials and with various dimensions. A given display box will accomodate pictures of somewhat smaller size than the maximum but a viewing frame with smaller opening may be necessary for a smaller picture. For a fixed assembly with non-removable viewing frame an auxiliary frame with a smaller opening may be attached, generally by adhesive, over the original frame. The following table gives examples of typical dimensions and materials for a product similar to that shown in FIG. 1 in a size intended for photographic or other prints $3\frac{1}{2}'' \times 5''$ or smaller.

| Member | Number on Drawing | Dimensions | Materials |
|---|---|---|---|
| Viewing frame. | 10 | Outside: $5'' \times 6\frac{1}{2}''$<br>Window: $2\frac{3}{4} \times 4\frac{1}{4}''$<br>Thick: 0.10" (Plastic) | Paperboard, plastic, wood, hardboard. |
| Corner posts. | 11a | Length: $1\frac{1}{4}''$<br>X-section: $\frac{3}{8}'' \times \frac{5}{8}''$ | Plastic, wood. |
| Back panel. | 12 | Outside $4\frac{1}{2}'' \times 6''$<br>Thick: 0.125" (Hardboard) | Paperboard, plastic, hardboard. |
| Backing sheet for print. | 13 | Face: $4\frac{1}{2}'' \times 5''$<br>Thick: 0.020" (Metal) | Paperboard, plastic, metal. |
| Depth position blocks. | 14 | Length: $\frac{5}{8}''$<br>Width: $\frac{1}{4}''$<br>Thick: $\frac{1}{4}''$ | Paperboard, wood, hardboard. |
| Side panels. | Not shown | Width: $1\frac{1}{4}''$<br>Length: sides 5", top $5\frac{7}{8}''$, bottom 6"<br>Thick: 0.060" (Paperboard) | Paperboard, plastic, wood. |

Both materials and dimensions in the above table are examples and do not precisely define or limit the invention.

FIG. 5 illustrates, in a partial exploded view, a second embodiment of the invention particularly adapted to larger sizes of pictorial matter but not limited thereto. For clarity side panels which may be used optionally to enclose the sides of the display box are not shown in FIG. 5. A rigid front frame, 51, is provided to the face of which a viewing frame, 52, is secured after a window of desired dimensions has been cut therein. The rigid front frame, 51, is made of wood, plastic, metal, hardboard, or other material of adequate strength, rigidity, and dimensional stability. The viewing frame, 52, is generally a mat board of conventional materials such as paperboard or textile-covered paperboard but other materials, such as plastic sheet or laminates of paper with polymers or wood veneer, may also be used. It is initially an uncut sheet with facial dimensions equal to or larger than the outside dimensions of the rigid front frame, 51. If larger the user may use the initial size or cut the sheet to smaller dimensions; however dimensions equal to the outside dimensions of the rigid front frame will be preferred in most cases.

When the viewing frame, 52, is ready for use with window cut in it as shown in FIG. 5 it is secured to the face of the frame, 51. This may be done by application of adhesive between said face and the back surface of the viewing frame. Other means of securing the viewing frame, 52, to the rigid frame, 51, may be employed providing the planarity of the viewing frame, parallel to the face of the rigid frame, and the position of the viewing frame relative to the rigid frame are maintained. For example screws may be employed which fit through both the viewing frame and the supporting rigid frame. In this case holes may be provided in the viewing frame to fit those in the rigid frame, or alternatively may be made by the user. Clips, preferably of metal or plastic, and preferably with a spring action, which fit over the edges of both viewing frame and rigid frame also can function in this way.

The fixed dimensions in the opening in the rigid frame, 51, are equal to or just slightly larger than the largest window to be used in the viewing frame, 52. The opening in the rigid frame may be cut perpendicularly through the thickness or may be cut with a bevel to larger dimensions on the rear face. The window in the viewing frame also may be cut with a bevel, opening in either direction, but it is generally thin enough that a perpendicular cut will suffice. The dimensions of the window in the viewing frame will be chosen by the user taking into account a number of factors. The size of the image, its composition with particular regard to the dimensions of that central portion of the image that should be seen by a viewer, its disposition and distance behind the viewing frame, and desired latitudes, vertically and horizontally, in the angle of view are usually the principal factors. A vertical latitude in the angle of view is employed to accomodate the range in eye level of different viewers and in typical circumstances will vary from about $\neq 8$ degrees to about $\neq 18$ degrees. When rare circumstances would require a latitude in vertical angle of view greater than $\neq 18$ degrees it will be desirable to change some factor or condition so as to reduce the requirement to $\neq 18$ degrees or less. If there are circumstances that require less than $\neq 18$ degrees in vertical latitude there is no problem.

The latitude in the horizontal angle of view within which the viewer, at a normal viewing distance, will not see a terminal side edge of the image will be determined by the horizontal dimension of the viewing window taken in relation to the width, disposition, and depth of recess of the pictorial matter. For example with a deeply recessed uni-planar disposition a latitude of anywhere from about $\neq 15$ degrees down to about $\neq 10$ degrees will generally be effective. In other cases such a limited latitude in horizontal angle of view will not be necessary as for example when the image, even though uni-planar, is substantially wider than the central portion of main interest and/or the maximum depth of recess is relatively small. The is also the case when the pictorial matter is in a convex curvilinear disposition with the side edges brought forward to be close to the rear surface of the front frame, or when the pictorial matter is made up in a multi-planar disposition with either continuous or separate sides brought forward close to the front frame. In these and similar cases the latitude in horizontal angle of view within which the observer will not see either side edge of the complete pictorial matter may be substantially greater than $\neq 15$ degrees.

Only rarely does a latitude in angle of view (horizontal or vertical) need to be applied within narrow limits; generally the viewing frame window dimension may vary within a range corresponding to $\neq 1\frac{1}{2}$ degrees from a "perfect" latitude without marked effect on viewer's interpretation or appreciation. In many cases an even larger tolerance is without marked effect. It should be noted that a viewer may shift his point of observation, laterally, to a more central location, and will usually do this automatically if he senses the possibility of greater aesthetic satisfaction by so doing. He also has an appreciable range, except for very small pictures, in the distance from which he can view the display. It may be noted further that while the maximum enhancement in aesthetic appreciation and in the perception of reality occur when observation is made from within the latitudes in angle of view, so that the limits of the image seen are defined by the window in the viewing frame, there is only a partial, and generally modest, diminution in the enhancement when viewing from a larger angle such that a portion of the edge of the image itself can be seen, providing the portion is less than 50 percent of the edge periphery of the image, and providing also that any important elements of the composition are not obscured. Calculation of appropriate dimensions of the window in the viewing frame for an image of given size, composition, disposition and distance behind the viewing frame, and an average, or a preferred, viewing distance may be done mathematically using some definite latitude, or latitudes, in the angle(s) of view. Alternatively empirical methods that are simpler and often more expedient may be employed with fully satisfactory results.

Referring again to FIG. 5 the fixed dimensions of the window in the rigid frame, 51, are chosen to accomodate an image of some specific size regardless of its disposition. These fixed window dimensions may be the same as those of the selected (nominal) image size or slightly smaller, especially if the cut is beveled to larger dimensions on the rear face. If the image size to be accomodated regardless of disposition is 16"×20" the product may be designated as a 16"×20" display box. The fixed dimensions of the window in the rigid frame, on its front face, might be as large as 16"×20" or as small as about 15½"×19½" With the use of typical latitudes in the angles of view a 16"×20" image would require a window, in the viewing frame, 52, less than 15½"×19½" even when disposed very close to the viewing frame and parallel to it. Typically the average depth behind the viewing frame, considering all likely dispositions, of a 16"×20" image will be from one inch to six inches. Within this range windows in the viewing frame will always be appreciably smaller than 15½"×19½". In an extreme example a 16"×20" image disposed parallel to the viewing frame and six inches behind it will require window dimensions of 10½"×14" to allow latitudes (both vertically and horizontally) in angles of view of about $\neq 15$ degrees at a viewing distance of 48". It will be evident from this example that a display box of given nominal size may accomodate a somewhat larger image if it is not disposed close to the viewing frame. Such larger image sizes are generally limited by the dimensions between the inner faces of the corner posts, 53 in FIG. 5, but not necessarily limited thereto. In the above example the dimensions between the corner posts might be 17"×21". It will be apparent that a strongly angled disposition, or a multiplanar or curvilinear disposition might allow an image even larger than 17"×21" in its original flat dimensions. While an image of any size smaller than 16"×20" could be accomodated in a 16"×20" display box most users will prefer a smaller display box for an image less than about 12"×15" in order that the ratio of outer dimensions to window dimensions of the viewing frame, 52, not be too large.

The corner posts, 53, are rigid posts having, in the design shown in FIG. 5, a square cross section. They are adapted or made of material to receive screws, 54, and 56, so as to hold the basic structure of the display box together. Wood and plastic are preferred materials for the corner posts although other rigid materials can be employed. The corner posts are of uniform length generally chosen in relation to the larger image sizes the display box is intended to accomodate. In the case of a display box designated as a 16"×20" display box as in the above example a suitable length would be six inches. The corner posts may be integral or may be provided in sections which can be joined to permit the use of different lengths. Thus three two-inch sections will provide for a choice of a two-inch, four-inch, or six-inch length. Integral corner posts may be marked to aid in cutting them to uniform shorter lengths should that be desired.

The back panel, 55, is attached to the ends of the corner posts with screws, 56. The primary function of the back panel is to aid in holding the assembly firm. It may contain holes or slots, not shown in FIG. 5, to aid in hanging the display box on a wall in either horizontal or vertical disposition. Alternatively rings or other devices may be attached to the back of the panel to aid in hanging. One or more hinged legs or vanes may be attached to the back to aid in supporting the box on a table or shelf. The back panel is generally a solid panel except for hanging holes or slots, and screw holes as shown in FIG. 5, but a frame similar in form to the rigid front frame, 51, will also function. A wide variety of materials may be employed for the back panel such as wood, metal, plastic, or foamed plastic and for smaller sizes even paper board will serve.

The screws, 56, in FIG. 5 may be countersunk with heads below the surface or flush with the panel but they need not be. Thus round head, oval head, or similar screws may be used. Another alternative is to employ wing screws or L-shaped screws having handles rather than symmetrical heads, or equivalent, which can be turned from the "snug" or assembled position to line up with a slot in the back panel extending outward from each screw hole so that the back panel can then be removed without removing the screws.

A picture mounted on a backing sheet, 57, is shown in FIG. 5 attached to inner surfaces of the corner posts by holders, 58. These holders are constructed from single-sided adhesive tape twisted centrally across its length to provide two adhesive surfaces at a right angle to each other. Since the holder is fixed in this twisted form, to provide strength and appropriate orientation of the two ends there will be right-handed and left-handed holders, one pair fitting one set of diagonally opposite corners and the other pair fitting the other set of corners. However there are various alternatives in the employment of adhesive tape as corner holders that obviate the right-handed versus left-handed distinction. Tape which can be twisted 180 degrees without tendency to unravel can be constructed, or two-sided tape may be employed, for example.

While side panels are not shown in FIG. 5 they are often a part of the completed display box. The previous description of side panels in connection with FIG. 1 applies equally to a box of the design shown in FIG. 5.

FIG. 7 is a cross-sectional end view, taken through a central plane of FIG. 5, of an assembled display box of the same general design as shown in FIG. 5. The viewing frame, 52, which may have outside dimensions equal to or larger than those of the rigid front frame, 71, is shown with a larger dimension in FIG. 7 to illustrate this option. The rigid front frame, 71, is adapted to receive a window, 73, which may be plastic or glass, in a recess cut into its front surface. Such a recess may be cut, alternatively, into the rear surface of the rigid frame. The window also can be mounted against the rear surface of the rigid frame or against its front surface, or on the front face of the viewing frame, 52. Such options require means to hold the window in place; the use of adhesive and the use of screws are two means. In FIG. 7 top and bottom side panels are shown in cross-section at 72. Other elements of the display box are the same as described for FIG. 5. Examples of dimensions and materials for the component parts, excepting screws, of a display box as partially illustrated in FIG. 5 are given in the following table for a nominal 16"×20" display box.

| Member | No. | Dimensions | Materials |
|---|---|---|---|
| Rigid front frame. | 51 | Outside: 20" × 24"<br>Window: 15½" × 19½"<br>Thick: 0.125" (Aluminum) | Metals, wood, plastic, hard-board. |
| Viewing frame. | 52 | Outside: 20" × 24"<br>Thick: 0.060" (Paperboard)<br>Window to be cut by user. | Paperboard, plastic, laminates of paper, plastic, etc. |
| Corner posts. | 53 | Length: 6"<br>Cross-section: ⅝" sq.<br>Orient: 17⅝" × 21⅝" center to center. | Wood, plastic, aluminum. |
| Back panel. | 55 | Outside: 18½" × 22½"<br>Thick: 0.125" (Hardboard) | Metal, plastic, hardboard, wood. |
| Backing sheet for print. | 57 | Face: 20" × 24", to be cut as required.<br>Thick: 0.060" (Paperboard) | Paperboard, plastic, metal. |
| Corner holders. | 58 | Each half: ¾" × ¼"<br>Thick: As available, generally 0.010" | Plastic, polymer, cloth, or paper adhesive tape. |
| Side panels. | 72 | Width: 6"<br>Length: Sides 18¼" top and bottom 22½"<br>Thick: ) .125" or less. | Plastic, wood, laminates of paper, plastic, textiles, etc. |

Both materials and dimensions in the above table are examples and do not define or limit the invention nor necessarily match either drawing or description of FIG. 5 or FIG. 7.

Figure 8:
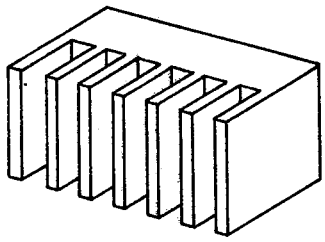
Figure 8:
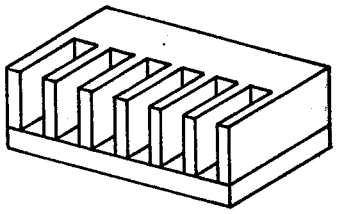

There are many alternative means for holding the pictorial matter in the selected corner positions some of which employ corner posts of different design than shown in FIG. 1 and FIG. 5. Thus FIGS. 6, 8, and 9 show three forms of slotted corner posts which allow positioning of each corner of the pictorial matter at one of several distances from the viewing frame without employing separate holders.

Figure 6:
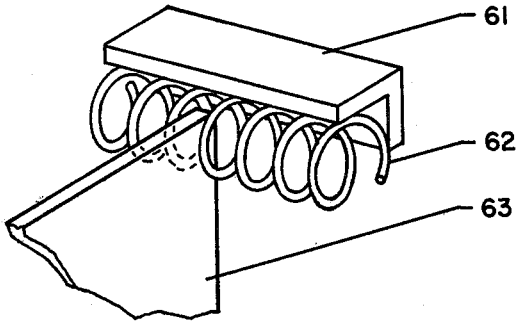

FIG. 6 shows a section of a corner post in which 62 is a spring of metal or plastic of pitch and spring constant to allow insertion of a corner of a mounted print, 63, and to hold the mounted picture in position. 61 is a corner piece having longitudinal edges terminating along lines about 90 degrees apart measured from the center of the spring. End pieces adapted to hold the spring and corner piece in fixed relation and to allow attachment of the thus completed corner post assembly to front and back of the display box are not shown in FIG. 6.

FIG. 8*a* represents one of two entry side corner posts and 8*b* is one of two stop side corner posts. The picture, usually mounted on a backing sheet, is inserted into the open-sided display box through the selected channels of the entry side corner posts and comes to rest on the bottom of the stop side corner posts. The slots, or channels, of corner posts such as illustrated in FIG. 8*a* and 8*b* are made substantially wider than the thickness of a mounted print or of whatever pictorial matter is to be accomodated so that the picture is easily inserted into the channels even if at an angle to the viewing frame. However if the angle is strong the backing sheet may be bent at its edges to better fit the channels. All four corner posts may be of the same design as shown in FIG. 8*a;* in this case wedges or adhesive tape, or equivalent, will be employed on the bottom corner posts to provide stops for the pictorial matter.

Figure 9A:
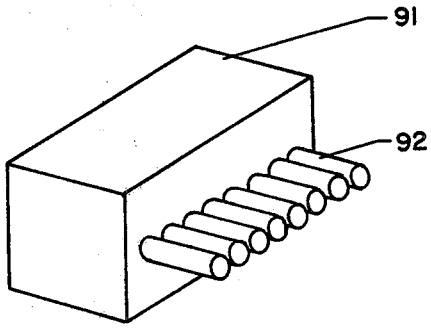

FIG. 9*a* shows a corner post fitted with rods, 92, held firmly in the main block, 91. Block and rods may be an integral piece as when molded from plastic or may be produced from separate pieces. Wood and plastic are preferred for the main block but some metals also can be employed. The rods may be made of wood, plastic, or metal. As examples the diameter of the rods may be ⅛" and the exposed length ¼" but both of these dimensions may be moderately smaller or larger assuming adequate stiffness of the rod material and adequate dimensions of the main block. Adjacent rods may be separated by a distance slightly exceeding the thickness of specific backing sheet material to be accomodated or a larger separation may be employed to receive a range of thicknesses. Wedges may be employed to firmly fix the pictorial matter in the selected position if desired. Adhesive tape or a cemented block may be employed below the rods on the lower corner posts to support the pictorial matter. Corner posts may be oriented with the rods horizontal as shown in FIG. 9*a* or may be oriented with the rods vertical in which case the pictorial matter is inserted from the side of the display box, rather than from the top. However the orientation of the display box, for display, may be horizontal or vertical in either case. If the angle of disposition is contrary to alignment of the pictorial matter along the length of the channels, or rods, the pictorial matter or, better, its backing sheet may be bent along the edges to slide in the channels. Alternatively "aileron" pieces may be taped to the edges of the mounted pictorial matter, which has been prepared to proper size.

Figure 9B:
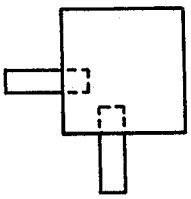

FIG. 9*b* shows the end view of an alternative corner post employing rods on both inner faces of the main block. Corner posts of this design may be permanently fixed to front frame and back panel and still permit disposition at an angle to the viewing frame in either the horizontal or vertical plane without the requirement of bending the edges or using aileron pieces. Such aids may be useful, however, for more complex dispositions.

A corner post in the form of a brush, having bristles anchored in one or both inner faces is another alternative to the slotted corner posts shown in FIGS. 6, 8*a*, 8*b*, 9*a*, and 9*b*. All these forms allow the user to locate a picture by sliding it through selected fixed slots or channels in an assembly completed except for one or more side panels. Such corner posts have the advantages of not requiring separate channel pieces or corner holders and, usually, of requiring fewer steps to complete a display. They are, however, not as flexible as other means of locating and holding corners of the pictorial matter, particularly for multi-planar and curvilinear dispositions.

Alternative means for fixedly holding the corners of the pictorial matter in addition to slotted corner posts, the depth position blocks shown in FIG. 1, and the twisted adhesive tape shown in FIG. 5, have also been found effective. If the corner posts are made of suitably soft or friable material such as paperboard, foamed plastic, or certain woods pins, thumbtacks, or equivalent may be employed in a number of ways. While ordinary pins will function a preferred means consists of a pronged U-sectioned channel, preferably of metal. The open portion of the U constitutes the channel within which the pictorial matter is held. One or more prongs extend downward from the U channel and are pressed into the side of the corner post in the desired location with respect to both the depth of recess behind the viewing frame and the angle of disposition of the pictorial matter at the corner being fixed. The channel is made wide enough to comfortably receive the mounted pictorial matter. For use with photographic prints a channel one-eighth inch wide and three-eighths inch long has been found functional. The channel walls may be of thickness and ductility that the sides can be squeezed together to hold the pictorial matter firmly or wedges may be employed with a more rigid U-section.

Other forms of corner holders comprised of a clip at one end which grips the mounted pictorial matter and which anchors into the corner post at the other end may be devised.

Another form of corner holder similar in shape to the twisted adhesive tape holder shown in FIGS. 5 and 7 has only one adhesive end which is secured to the mounted pictorial matter. The opposite end is a thin tab of strong paper, polymer, textile, or equivalent, which is pinned to the face of the corner post with a thumb tack, or is secured thereto by cementing or with a separate piece of adhesive tape. The material of which the corner post is constructed of course will determine whether a thumb tack may be used.

Magnetic holders also may be employed. For example thin steel plates may be fixed to the back of the pictorial matter at each corner and a thin steel facing on inner faces of the corner posts. Four permanent magnets of rectangular prismatic, or other appropriate, shape are then attached at the four corners and at the selected positions and angles along the faces of the corner posts. Alternatively magnetic tape may be adhesively, or magnetically, held to the corners of the pictorial matter at one end and flexed to attach magnetically to the steel facing on the corner posts.

The previously described embodiments of my invention incorporate four individual corner posts. A further embodiment is shown in FIG. 10 employing two spacing panels, 103, in which the shaded end portions constitute the four corner posts. In this particular embodiment the spacing panels are cemented to the rear face of a viewing frame, 101, and the front face of the spacing panel, 102. The side panels may be opaque but preferably are made of clear plastic. In the latter case transparency is available if desired, or one or both panels may be made opaque by covering the outer surface(s) with opaque material. The inner faces of the corner post end portions of the spacing panels, shown shaded in FIG. 10, may be covered with paper, or may be roughened, to allow better adherence of adhesively applied tape, depth position blocks, or other elements employed in locating and retaining corners of the pictorial matter. The shaded areas may also represent thin metal plates adhesively applied; in such case magnetic means are employed to hold the pictorial matter.

The spacing panels shown in FIG. 10 are of uniform thickness usually not exceeding 0.125" and cemented to the front frame and back panel. If it is desired to employ screws to secure the spacing panels to the front frame, or the back panel, or both, thicker spacing panels may be employed or spacing panels that are thicker where screws are to be received. Thus in FIG. 11 is shown a left spacing panel as seen from the front which has two integral enlarged sections for corner posts. A pair of such spacing panels screwed to front frame, or back panel, or both, will provide a relatively strong structure. This form of spacing panel, compared to that shown in FIG. 10, also has the advantage that the corner posts present both horizontal and vertical attachment surfaces for retention of the corners of the pictorial matter.

The embodiments of the invention described relative to FIGS. 1, 5, and 10 may be produced in assembled forms or in "knocked-down" kit forms for complete assembly by the user.

In a kit suitable for construction of a display box similar to that shown in FIG. 1, or in FIG. 10, the viewing frame may be pre-cut as shown in the drawings or, alternatively, may be a solid sheet without window to be cut by the user to select window dimensions, and to selected outside dimensions if the latter are smaller than provided. In a kit suitable for construction of a display box similar to that shown in FIG. 5 the viewing frame is a solid sheet without window until cut by the user, and the rigid supporting frame may be provided with or without window. In preparing window cut-outs one may proceed conventionally by measuring, marking with pencil, and sawing or cutting with knife or razor blade. Alternatively corners of a rectangular window can be marked by employing a template such as a piece of graph paper, or equivalent, and pin or sharp-pointed stylus. Such a template also may be employed for locating screw holes in a back panel or front frame and for marking a backing sheet for proper location of a print, and may be provided as part of a kit. Another alternative is to provide sheets for viewing frames and rigid front frames with grids of uniformly spaced parallel lines and distance scales marked on their back sides. Backing sheets and back panels also may be provided with similar pre-printed guide lines for locating a print or screw holes.

Frequently it is desired to light a picture disposed in a display box at least partially from behind the viewing frame. While this can be done with external lights that are independent of the display box a further embodiment of the invention is a display box having an attached lighting system. The lighting system may be powered through an extension cord from an ordinary electrical power receptacle, or may be powered from one or more batteries attached to the display box. One or more batteries may be held in a bracket attached to either face of the back panel or to the rear face of a rigid front frame such as 51 in FIG. 5. In the latter case the bracket and batteries generally are located at the bottom of the rigid frame in the display position, and laterally outward of the total space available for disposition of the pictorial matter. One or more lamp sockets are located outwardly of this same space, said sockets supported from the back panel or the rigid front frame, or both. The lamp sockets may be supported in fixed position or may be mounted, as for example on a track, to allow flexibility in position. They may be mounted also on swivel joints in order to allow flexibility in attitude. Reflectors supported by lamp sockets, by front frame, by back panel, or by any combination of these, also may be employed. Reflectors are necessarily located close to the front frame in order to direct light inwardly toward the pictorial matter. In the absence of reflectors lamps must be located close to the front frame.

Conductors to the lamp sockets are disposed close to either the front or the rear surface of the back panel or close to the rear surface of the rigid front frame until, in their path from power source to lamp sockets, they must depart from such surface in order to reach said sockets. When a conventional conductor is disposed close to the front surface of the back panel or the rear surface of the rigid front frame it is maintained inwardly of side panel positions. To pass from one side of a corner post to another it may pass through a channel cut in the end of the corner post, said channel terminating on the two inner faces of the corner post. Alternatively conductors may be routed in grooves cut in either rigid front frame or back panel to maintain the outer surface of the conductor at or below the surface of said front frame or back panel. However printed conductors, painted conductors, or very thin flat conductors may be employed and are preferred. Channels in the ends of corner posts or grooves in the front frame or back panel are not then required.

An attached lighting system generally includes a switch, preferably hidden from a front view and supported by front frame or back panel near an outer edge. Except for switch and conductors connected thereto a battery powered lighting system may be fully enclosed within side panel positions, employing spacers between corner posts and side panels or corner posts with enlarged cross-section if necessary. However such full enclosure is not essential although it is aesthetically desirable to keep at least batteries and their brackets hidden from view.

I have found no practical limit with respect to image size for which there is no enhancement in the perception of reality when a picture of appropriate subject matter is recessed an adequate distance behind a viewing frame. Display boxes have been built, and proven effective, for images from $2\frac{1}{4}'' \times 3\frac{1}{4}''$ to $24'' \times 36''$ and mock-up tests have shown that enhancement in the perception of reality can be observed for images both smaller and larger than that range. Thus the invention is applicable to a wide range of image sizes and accordingly of facial dimensions of viewing frames, rigid front frames, and back panels, limited only on the small end of the range by the impracticality of displaying and observing images smaller than about $2'' \times 2''$.

The optimum depth behind the plane of the viewing frame to mount a picture in a given disposition is not a critically precise depth. Rather there is an optimum range in depth over which there is an imperceptible, or nearly imperceptible, change in the enhancement in perception of reality. Thus there is no difficulty in locating a picture with respect to depth so as to achieve essentially the maximum enhancement for the chosen disposition. In my experience I have found that one will choose to mount most pictures with their most deeply recessed portion a distance behind the plane of the viewing frame of one-twelfth to one-fourth of the open distance between diagonally opposite corner posts taken on a line parallel to the viewing frame and passing through the outer corners of the corner posts. If the corner posts are of square cross-section this "open distance" is the diagonal between inner corners of the corner posts. In a small fraction of cases one may choose to mount a picture with its most deeply recessed portion a distance less than one-twelfth or more than one-fourth of the "open distance" behind the plane of the viewing window. In the case of display boxes with corner posts of fixed (not adjustable) length I prefer to provide a length not less than about one-fourth of the "open distance". In the case of kits or removable corner posts that may be adjusted in length a maximum length of one-third the "open distance", or slightly more, is a good standard. It should be noted, however, that display boxes allowing for an even greater depth of recess will function; in other words space behind the mounted picture does not influence the view from in front of the display box. It may be noted also that display boxes having maximum depths of recess less than one-quarter, even down to about one-eighth, of the "open distance" will be of adequate depth for many pictures depending, in part, on the disposition chosen for display.

While I have described my invention and its applications with reference to rectangular images and rectangular windows it will be apparent that it is applicable as well to round or oval formats.

In the claims the term "prepared pictorial matter" refers to pictorial matter that is suited, by its physical properties and dimensions, to fit a chosen disposition for display, or that has been prepared so to fit by such operations as: mounting on a backing sheet of suitable dimensions and rigidity; bending or cutting and taping if to be multi-planar; bending edges of the pictorial matter or of a backing sheet, or by any similar operations.

As previously indicated the term "corner post" implies either an individual post or an end portion of a spacing panel.

I claim:

1. A structural assembly for display of pictorial matter in any choice of a variety of uni-planar, multi-planar, curvilinear, or combined curvilinear and planar dispositions comprised of a front frame such as may be produced from sheet stock and having an inner cut-out area constituting a viewing window with a first set of dimensions, to either face of which front frame a mat sheet, or equivalent, with equal or smaller viewing window dimensions optionally may be attached, a back panel disposed rearwardly of said front frame and spaced therefrom by four corner posts attached at one end to said front frame adjacent the corners of, and wholly outside of, a rectangle encompassing said cut-out area, and at the other end to said back panel, said corner posts of lengths not substantially less than one-twelfth the square root of the area of said rectangle, each adjacent pair of said corner posts having outer longitudinal surfaces lying in a common plane, means to locate and retain each of four corners of prepared pictorial matter in the proximity of an inner surface of the corresponding corner post at any of a plurality of distances measured from said front frame toward said back panel, the chosen dimensions of the viewing window being sufficiently large to fully display that central portion of the image it is desired to display but sufficiently smaller than those of the image of the pictorial matter, taking account of the disposition and depth of recess behind the viewing window of said image, so that a viewer in a generally central location but not substantially closer than an average viewing distance will see with each eye only a portion of said image, both such portions having their edges as defined by the projection of the viewing window upon the image along the viewer's lines of sight everywhere within the outer edges of said image.

2. The structural assembly of claim 1 including attached thereto one or more electrically powered light sources and optionally, reflectors, said light sources and reflectors each supported by a structural member of the assembly and located laterally outward of space defined by a translation of said rectangle perpendicularly to said front frame, with light sources or reflectors, or both, located in the proximity of the plane in which the rear surface of said front frame resides, and disposed or attitudinally adjustable so that light from said light sources can be directed from such location rearwardly and laterally inward between the front frame and the prepared pictorial matter disposed in its display position to strike said image, no substantial portion of said light passing inwardly through the cut-out area of said front frame.

3. The structural assembly of claim 2 in which one or more side panels are provided, each such panel fitting one of the four sides of the assembly between said front frame and said back panel externally of the corner posts, and which may be opaque, transluscent, clear transparent, or color-filtering.

4. The structural assembly of claim 2 in which all parts of the lighting system except an extension cord and one or more switches may be enclosed within side panels provided for this purpose, each such panel fitting one of the four sides of the assembly between said front frame and said back panel externally of the corner posts, and which may be opaque, transluscent, clear transparent, or color-filtering.

5. The structural assembly of claim 2 in which said one or more light sources are part of a battery powered lighting system comprised of at least: one or more batteries, conductors, and one or more lamps, with each part of said lighting system attached to and supported directly or indirectly by said structural assembly.

6. The structural assembly of claim 5 in which one or more side panels are provided, each such panel fitting one of the four sides of the assembly between said front frame and said back panel externally of the corner posts, and which may be opaque, transluscent, clear transparent, or color-filtering.

7. The structural assembly of claim 5 in which all parts of the lighting system except one or more switches may be enclosed within side panels provided for this purpose, each such panel fitting one of the four sides of the assembly between said front frame and said back panel externally of the corner posts, and which may be opaque, transluscent, clear transparent, or color-filtering.

8. The structural assembly of claim 1 in which at least two of said corner posts have incorporated each in its structure channels, bristles, rods, or a spring member, which incorporated elements are oriented inwardly and adapted by their dimensions, spacing, and physical properties, to receive an edge portion at or near a corner of said prepared pictorial matter at any of a plurality of positions between said front frame and said back panel, so as to provide at least a part of the means to locate and retain the corners of said prepared pictorial matter.

9. The structural assembly of claim 8 in which one or more side panels are provided, each such panel fitting one of the four sides of the assembly between said front frame and said back panel externally of the corner posts, and which may be opaque, transluscent, clear transparent, or color-filtering.

10. The structural assembly of claim 1 in which one or more side panels are provided, each such panel fitting one of the four sides of the assembly between said front frame and said back panel externally of the corner posts, and which may be opaque, transluscent, clear transparent, or color-filtering.

11. A structural assembly for display of pictorial matter comprised of a front frame containing an inner cut-out area to serve as a viewing window of appropriate dimensions, a back panel disposed rearwardly of said front frame and spaced therefrom by up to four spacing members each attached at one end to said front frame wholly outside of a first rectangle encompassing said cut-out area and wholly within the outer edges of said front frame, and attached at the other end to said back panel, the outer surfaces of said spacing members tracing the four corners of a rectangle larger than said first rectangle at any cross-section taken parallel to said front frame, and thus defining four planar sides of a volume of space extending from the rear surface of the front frame to the forward surface of said back panel, a distance not substantially less than one-twelfth the square root of the area of said first rectangle, said spacing members being of such dimensions and/or light transmitting character that side lighting can be employed when and if elected, in addition to any front lighting employed, said side lighting reaching the image by passing laterally inward from behind said front frame with no substantial part of such side lighting passing inwardly through the viewing window, and means to locate and maintain within said volume of space prepared pictorial matter visibly recessed a selected distance behind the viewing window in a uni-planar, multi-planar, curvilinear, or in a combined curvilinear and planar disposition, said appropriate dimensions of the viewing window being those sufficiently large that the central portion of the image that it is desired to display will be fully displayed to a viewer in a normal viewing position, but sufficiently smaller than the dimensions of the image, taking account of the disposition of the image and its depth of recess behind the viewing window, so that a viewer in a generally central location but not substantially closer than a normal viewing distance will see with each eye only a portion of the complete image, both such portions having their edges as defined by the projection of the viewing window upon the image along the viewer's lines of sight everywhere within the outer edges of said image.

12. The structural assembly of claim 11 in which said front frame is in the form of a single panel and no mat sheet, or equivalent, for attachment thereto is provided.

* * * * *